US009420646B2

(12) United States Patent
Chen

(10) Patent No.: US 9,420,646 B2
(45) Date of Patent: Aug. 16, 2016

(54) CIRCUIT WITH AN LED DIMMING LINEAR COMPENSATION

(71) Applicant: XIAMEN YANKON ENERGETIC LIGHTING CO., LTD., Xiamen, Fujian (CN)

(72) Inventor: Senhai Chen, Xiamen (CN)

(73) Assignee: XIAMEN YANKON ENERGETIC LIGHTING CO., LTD., Xiamen (CN)

( * ) Notice: Subject to any disclaimer, the term of this patent is extended or adjusted under 35 U.S.C. 154(b) by 0 days.

(21) Appl. No.: 14/410,134

(22) PCT Filed: Oct. 10, 2013

(86) PCT No.: PCT/CN2013/084981

§ 371 (c)(1),
(2) Date: Dec. 22, 2014

(87) PCT Pub. No.: WO2014/134918

PCT Pub. Date: Sep. 12, 2014

(65) Prior Publication Data

US 2016/0021711 A1 Jan. 21, 2016

(30) Foreign Application Priority Data

Mar. 6, 2013 (CN) ..... 2013 2 0102401 U

(51) Int. Cl.
*H05B 33/08* (2006.01)

(52) U.S. Cl.
CPC ..... *H05B 33/0815* (2013.01); *H05B 33/0851* (2013.01)

(58) Field of Classification Search
CPC ..... H05B 33/08; H05B 33/0815
USPC ..... 315/206, 297, 307
See application file for complete search history.

(56) References Cited

U.S. PATENT DOCUMENTS

2010/0001661 A1 1/2010 Huang et al.
2010/0259956 A1 10/2010 Sadwick et al.
2013/0249437 A1* 9/2013 Wang ..... H05B 33/0815 315/307
2013/0293151 A1* 11/2013 Puvanakijjakorn H05B 33/0815 315/297
2015/0296574 A1* 10/2015 Knoedgen ..... H05B 33/08 315/307

FOREIGN PATENT DOCUMENTS

CN 202103918 U 1/2012
CN 202143262 U 2/2012
CN 203219540 U 9/2013

* cited by examiner

*Primary Examiner* — Don Le
(74) *Attorney, Agent, or Firm* — Rabin & Berdo, P.C.

(57) ABSTRACT

A circuit with an LED dimming linear compensation, which includes: a rectification circuit with two inputs connected to the alternating current and two DC outputs, a positive DC output and a negative DC output; a filter circuit with inputs connected to the DC outputs and a positive output and a negative output to output positive pole and negative pole; a RCC drive circuit with an oscillating circuit to drive the LED light source by RCC mode; and a compensation resistance R1 series connected in the front stage of one input of the rectification circuit. The compensation resistance R1 is disposed in the front stage of the rectification circuit, when the branch current increases, the voltage of the RCC drive circuit in the followed stage decreases, as the RCC drive circuit is similar to a resistant load, it improves the voltage-current characteristic of the circuit.

6 Claims, 1 Drawing Sheet

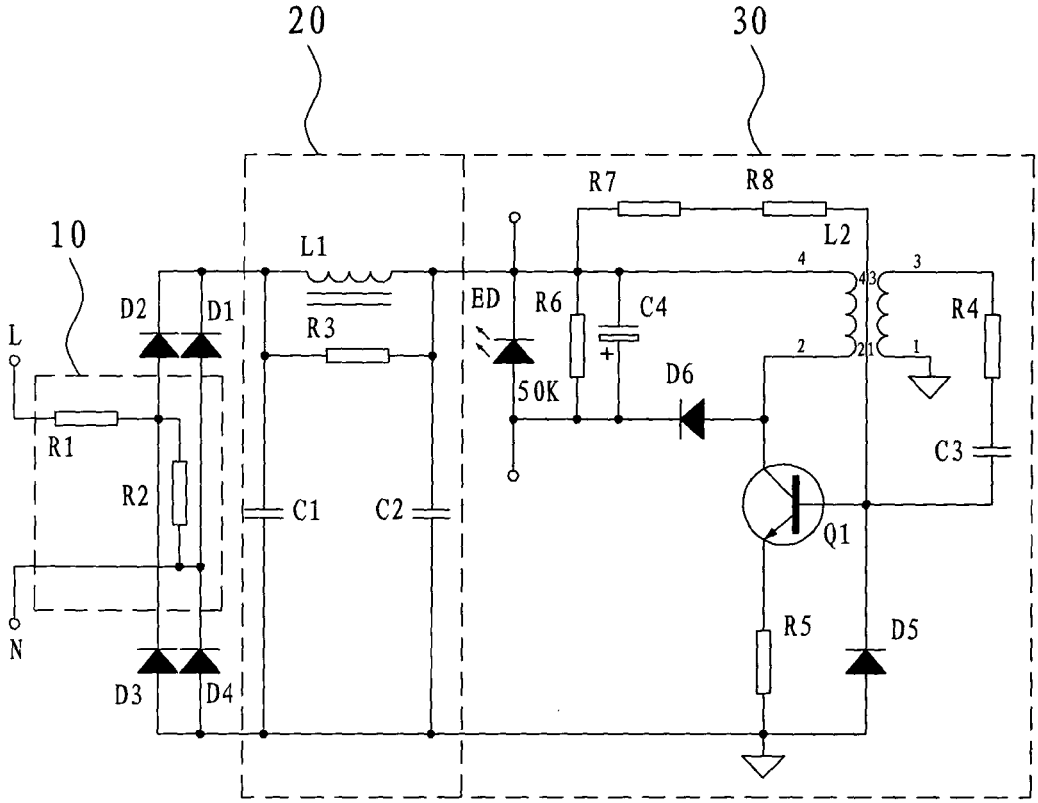
20
30
10
L
N
D2
D1
D3
D4
R1
R2
L1
R3
C1
C2
ED
50K
R6
C4
R7
R8
L2
D6
Q1
R5
D5
R4
C3
4
3
43
2
21
1

CIRCUIT WITH AN LED DIMMING LINEAR COMPENSATION

FIELD OF THE INVENTION

The present invention relates to an illumination power supply circuit, especially to a circuit with an LED dimming linear compensation.

BACKGROUND OF THE INVENTION

Lighting equipments are dimmable and this function has made remarkable process, one kind of dimmer is applied with silicon-controlled, in which it adjusts the light by controlling the conduction angle. This kind of silicon-controlled mode is based on incandescent lamps with simple resistance load, so that it needs the lamp with good resistive in the voltage-current characteristic.

However, LED lights have replaced the traditional incandescent lamps in many places. This kind of device with LED light source needs consideration driving characteristic that it is applied with many non-resistive components like inductances and capacitances to realize driving function with oscillation and variation. So that the whole load of the LED light is different from the simple resistance load in the voltage-current characteristic. Scintillation, bad dimmer linearity and other problems will happen if applying silicon-controlled mode to adjust the light.

SUMMARY OF THE INVENTION

The present invention is provided with a circuit with an LED dimming linear compensation to overcome above problem that the LED lights has non-linear characteristic that it is in bad adaptability to the silicon-controlled dimmer. The technical proposal of the present invention is that:

A circuit with an LED dimming linear compensation, comprising:

a rectification circuit with two inputs connected to the alternating current and two DC outputs, a positive DC output and a negative DC output;

a filter circuit with inputs connected to the DC outputs and a positive output and a negative output to output positive pole and negative pole;

a RCC drive circuit with an oscillating circuit to drive the LED light source by RCC mode; and a compensation resistance R1 series connected in the front stage of one input of the rectification circuit.

In another preferred embodiment, the rectification circuit includes bridge rectifiers for full-wave rectification; a leak resistance R2 is disposed between two inputs.

In another preferred embodiment, the filter circuit comprises an inductance L1 with two ends respectively connected to the negative DC output via a capacitance C1 and a capacitance C2; the connection of the capacitance C1 and the inductance L1 is connected to the positive DC output of the rectification circuit; the connection of the capacitance C2 and the inductance L1 is served as the positive output; a resistance R3 is parallel connected to the inductance L1.

In another preferred embodiment, the RCC drive circuit comprises:

a transformer L2, the end 4 of the primary winding is connected to the positive output of the filter circuit, the end 2 is connected to the collector of the switch tube Q1; the end 3 of the secondary winding is connected to the base of the switch tube Q1 via series connected resistance R4 and capacitance C3; the end 1 is grounded;

the end 2 of the primary winding of the transformer L2 is connected to the positive pole of a diode D6, a resistance R6 and an electrolytic capacitance C4 are connected between the end 4 and the negative pole of the diode D6; the end 4 is connected to a diode D5 via a resistance network, the positive pole of the diode D5 is grounded;

the emitter of the switch tube Q1 is grounded via a resistance R5; the ground is connected to the negative output.

The technical proposal of the present invention has advantages as below:

1. the compensation resistance is disposed in the front of the rectification circuit, when the branch current increases, the voltage of the RCC circuit in the followed stage decreases, as the RCC drive circuit is similar to a resistant load, it improves the voltage current characteristic of the circuit, so that the circuit is improved to adapt to the silicon-controlled dimmer.
2. the compensation resistance and the leak resistance form a discharge circuit, which is able to control and leak the current peak.
3. the technical proposal is composed of separations, so that it has fewer circuit devices and costs low, and the process is simpler.

BRIEF DESCRIPTION OF THE DRAWINGS

The present invention will be further described with the drawings and the embodiments.

FIG. 1 illustrates a circuit schematic diagram of the present invention.

DETAILED DESCRIPTION OF THE EMBODIMENTS

As figured in FIG. 1, it illustrates a circuit diagram of an embodiment of the present invention.

In this embodiment, a circuit with an LED dimming linear compensation comprises a rectification circuit, a filter circuit and a RCC drive circuit. The rectification circuit includes bridge rectifiers for full-wave rectification, comprising D1-D4; a compensation resistance R1 is configured in the front stage of one input, a leak resistance R2 is configured between two inputs. The negative poles of D1 and D2 are connected together to serve as a positive DC output, the positive poles of D3 and D4 are connected together to server as a negative DC output.

The followed stage of the rectification circuit is the filter circuit. The filter circuit comprises an inductance L1, two ends of which are respectively connected to the negative DC output of the rectification circuit via a capacitance C1 and a capacitance C2; the connection of the capacitance C1 and the inductance L1, that is the input of the filter circuit, is connected to the positive DC output of the rectification circuit; the connection of the capacitance C2 and the inductance L1 is served as the positive output; a resistance R3 is parallel connected to the inductance L1.

The RCC drive circuit comprises an oscillating circuit to drive the LED light source by RCC mode, it comprises a transformer L2, the end 4 of the primary winding is connected to the positive output of the filter circuit, that is the connection of the L1 and R3, the end 2 of the primary winding is connected to the collector of the switch tube Q1; the end 3 of the secondary winding is connected to the base of the switch tube Q1 via series connected resistance R4 and capacitance C3; the end 1 of the secondary winding is grounded;

The end 2 of the primary winding of the transformer L2 is connected to the positive pole of a diode D6, a resistance R6 and an electrolytic capacitance C4 are connected between the end 4 and the negative pole of the diode D6; the end 4 of the primary winding is connected to a diode D5 via a resistance network, the positive pole of the diode D5 is grounded;

The emitter of the switch tube Q1 is grounded via a resistance R5; the ground is connected to the negative output.

The compensation resistance R1 is disposed in the front stage of the rectification circuit, when the branch current increases, the voltage of the RCC drive circuit 30 in the followed stage decreases, as the RCC drive circuit is similar to a resistant load, it improves the voltage current characteristic of the circuit, so that the circuit is improved to adapt to the silicon-controlled dimmer.

The compensation resistance R1 and the leak resistance R2 form a discharge loop 10, which is able to control and leak the current peak. The loop 20, that is the filter circuit, is disposed at the followed stage of the rectification circuit, the filter circuit has small capacitance, so that it can compensate the whole circuit, making it near to the resistance load as possible. Despite electromagnetism, the loop 20 is coupled to the loop 10 to limit the peak current and provide extra current discharge loop, thus stabling the dimmer. Particularly, this embodiment is composed of separations, so that it has fewer circuit devices and costs low, and the process is simpler. In the real design, the filter circuit can be changed according to different standards; the RCC drive circuit also can be changed according to load power characteristic and the cost.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A circuit with an LED dimming linear compensation, comprising:

a rectification circuit with two inputs connected to an alternating current and two DC outputs, a positive DC output and a negative DC output;

a filter circuit with inputs connected to the DC outputs and a positive output and a negative output to output positive pole and negative pole;

a RCC drive circuit with an oscillating circuit to drive the LED light source by RCC mode; and a compensation resistance R1 series connected in a front stage of one input of the rectification circuit.

2. The circuit with an LED dimming linear compensation according to claim 1, wherein the rectification circuit includes bridge rectifiers for full-wave rectification; a leak resistance R2 is disposed between two inputs.

3. The circuit with an LED dimming linear compensation according to claim 1, wherein the filter circuit comprises an inductance L1 with two ends respectively connected to the negative DC output via a capacitance C1 and a capacitance C2; the connection of the capacitance C1 and the inductance L1 is connected to the positive DC output of the rectification circuit; the connection of the capacitance C2 and the inductance L1 is served as the positive output; a resistance R3 is parallel connected to the inductance L1.

4. The circuit with an LED dimming linear compensation according to claim 1, wherein the RCC drive circuit comprises:

a transformer L2, the end 4 of the primary winding is connected to the positive output of the filter circuit, the end 2 is connected to the collector of the switch tube Q1; the end 3 of the secondary winding is connected to the base of the switch tube Q1 via series connected resistance R4 and capacitance C3; the end 1 is grounded;

the end 2 of the primary winding of the transformer L2 is connected to the positive pole of a diode D6, a resistance R6 and an electrolytic capacitance C4 are connected between the end 4 and the negative pole of the diode D6; the end 4 is connected to a diode D5 via a resistance network, the positive pole of the diode D5 is grounded;

the emitter of the switch tube Q1 is grounded via a resistance R5; the ground is connected to the negative output.

5. The circuit with an LED dimming linear compensation according to claim 2, wherein the RCC drive circuit comprises:

a transformer L2, the end 4 of the primary winding is connected to the positive output of the filter circuit, the end 2 is connected to the collector of the switch tube Q1; the end 3 of the secondary winding is connected to the base of the switch tube Q1 via series connected resistance R4 and capacitance C3; the end 1 is grounded;

the end 2 of the primary winding of the transformer L2 is connected to the positive pole of a diode D6, a resistance R6 and an electrolytic capacitance C4 are connected between the end 4 and the negative pole of the diode D6; the end 4 is connected to a diode D5 via a resistance network, the positive pole of the diode D5 is grounded;

the emitter of the switch tube Q1 is grounded via a resistance R5; the ground is connected to the negative output.

6. The circuit with an LED dimming linear compensation according to claim 3, wherein the RCC drive circuit comprises:

a transformer L2, the end 4 of the primary winding is connected to the positive output of the filter circuit, the end 2 is connected to the collector of the switch tube Q1; the end 3 of the secondary winding is connected to the base of the switch tube Q1 via series connected resistance R4 and capacitance C3; the end 1 is grounded;

the end 2 of the primary winding of the transformer L2 is connected to the positive pole of a diode D6, a resistance R6 and an electrolytic capacitance C4 are connected between the end 4 and the negative pole of the diode D6; the end 4 is connected to a diode D5 via a resistance network, the positive pole of the diode D5 is grounded;

the emitter of the switch tube Q1 is grounded via a resistance R5; the ground is connected to the negative output.

* * * * *